United States Patent [19]

Hauser et al.

[11] Patent Number: 4,881,327

[45] Date of Patent: Nov. 21, 1989

[54] DRYER SECTION

[75] Inventors: Ludwig Hauser; Winfried Haessner, both of Heidenheim, Fed. Rep. of Germany

[73] Assignee: J. M. Voith GmbH, Heidenheim, Fed. Rep. of Germany

[21] Appl. No.: 308,258

[22] Filed: Feb. 8, 1989

[30] Foreign Application Priority Data

Mar. 10, 1988 [DE] Fed. Rep. of Germany ..... 3807857

[51] Int. Cl.[4] ..... F26B 5/00

[52] U.S. Cl. ..... 34/114; 34/116; 34/117

[58] Field of Search ..... 34/114, 115, 116, 117, 34/120

[56] References Cited

U.S. PATENT DOCUMENTS

| | | | |
|---|---|---|---|
| 3,110,575 | 11/1963 | Justus | 34/116 X |
| 3,587,177 | 6/1971 | Overly | 34/156 |
| 4,502,231 | 3/1985 | Fissmann et al. | 34/114 |
| 4,698,918 | 10/1987 | Kotitschke et al. | 34/117 |
| 4,786,529 | 11/1988 | Boissevain | 34/114 X |
| 4,821,429 | 4/1989 | Sieberth | 34/116 |

FOREIGN PATENT DOCUMENTS 3630571 3/1987 Fed. Rep. of Germany .

*Primary Examiner*—Harold Joyce

*Attorney, Agent, or Firm*—Albert L . Jeffers; Richard L. Robinson

[57] ABSTRACT

A dryer section in which a paper web to be dried meanders successively over several drying cylinders, which are arranged in two rows one above the other. To the top row of cylinders is allotted a top supporting belt and to the bottom row of cylinders a bottom supporting belt. Between each two drying cylinders each of the supporting belts runs over a carrier roll. At the open paper draws are provided web stabilizers of which each exhibits several nozzle elements with one air blow slot each and a web-guiding surface interacting with it. The direction of flow of the blow air is at all nozzle elements the same as the direction of travel of the paper web. Each web stabilizer is designed as an exhaust-air box surrounding the nozzle elements, to which an exhaust-air pipe is connected.

15 Claims, 2 Drawing Sheets

DRYER SECTION

BACKGROUND OF THE INVENTION

The invention relates to a dryer section for a machine for the production or processing of fibrous webs, in particular paper webs, of the type having the following features (a) several heatable drying cylinders arranged in two rows one above the other so that the fibrous web meanders through the dryer section;

(b) to the top row of cylinders is allotted a top supporting belt and to the bottom row of cylinders a bottom supporting belt, with each supporting belt running in the direction of web travel behind a drying cylinder over a carrier roll;

(c) in at least one part of the pockets, of which each is delimited by the free peripheral part of a drying cylinder, by the opposite carrier roll and by the fibrous web is provided a device for the contactless stabilization of the run of the fibrous web ("web stabilizer"); and (d) the web stabilizer comprises at least one nozzle element extending transversely across the width of the web and connected to a supply-air pipe, which exhibits an air blow slot open towards the fibrous web and a web-guiding surface interacting with it.

Such a dryer section is known from German Pat. Document No. 36 30 571.

The web stabilizer used in this known dryer section includes a blow box with approximately trapezoidal cross-section The main feature of this blow box is that there are two blow nozzles acting in opposite directions at its web-guiding surface. Thus one blow nozzle blows in the direction of web travel, and the other in the opposite direction. Each of the two air jets flows (viewed in the cross-section) in the direction towards the end of the web-guiding surface and thereafter into the atmosphere, i.e., into the internal space, also called "pocket", which is delimited by the free peripheral section of one of the drying cylinders, by the opposite carrier roll and by the fibrous web which runs on one side onto the said cylinder and on the other side runs off it. Although it is desired that a certain overpressure should exist in such a pocket, with the known arrangement there is a danger that this overpressure will assume too high a value.

From the aforementioned reference no. 36 30 571 it is also known (FIG. 7) for a carrier roll to be arranged at least one of the drying cylinders in such a way that its periphery is, at a certain distance from the exiting point of the fibrous web from the drying cylinder, tangent to the running path of the fibrous web. In this connection it is of importance that the different embodiments of the web stabilizer known from reference no. 36 30 571 have the common feature that they are arranged on that side of the fibrous web which contacts the subsequent drying cylinders. The aim of this is that the web stabilizer should draw the fibrous web "firmly against the surface of the dryer fabric" by means of suction.

According to reference no. 36 30 571 the aim is also to make the length of the web stabilizer, viewed in the cross-section, as large as possible so that the free (unsupported) areas of the fibrous web are relatively short.

SUMMARY OF THE INVENTION

The problem which the invention addresses is to improve the well-known arrangement of a dryer section with web stabilizers to the extent that a still more stable guiding of the fibrous web than hitherto known is achieved with as low an expenditure of blow air as possible and that, simultaneously, an undesired rise of air pressure in the pocket is avoided.

Some objects of the dryer section according to the invention are, inter alia, the achievement of an additional drying effect by the web stabilizers and on threading of the paper web into the dryer section, the so-called transfer tail can be led through the dryer section without the help of a rope carrier system or such like.

A principal objective of the invention consists in further developing the well-known dryer section so that it can be operated with a higher working speed than hitherto known and that nevertheless the risk of fluttering of the web edges at the open web draws and the danger of web breakage is reduced as far as possible. The target working speed is of the order of magnitude of 1500 m/min or even above.

According to one aspect of the invention, provision is first of all made in the web stabilizers for the direction of flow of the blowing air over the web-guiding surfaces to be the same at all times as the direction of web travel. This means, inter alia, that the blowing of air counter to the direction of web travel is avoided. In this way, it can be expected, on the one hand, that there will be a certain saving in the generation of the necessary blow-air pressure and, on the other, the avoidance of a certain braking effect on the fibrous web.

In a preferred embodiment of the invention of this application, as in the known arrangement, provision has been made for each web stabilizer to generally exhibit at least two nozzle elements. Since now, however, as already mentioned, all these elements are to take effect in the same direction, i.e. the direction of web travel, it is no longer possible to combine two nozzle elements to form one single blow box as with the known arrangement. According to the invention, it is instead provided to arrange the nozzle elements within one exhaust-air box. This collects the blow air exhausted from the nozzle elements and at the same time takes it laterally, i.e. on the tending and/or drive side, out of the dryer section. Two things are achieved in this way: on the one hand, the creation of an unnecessarily high overpressure in the pocket is avoided. On the other hand, the water vapor absorbed by the blow air is discharged outwards over the shortest distance. This discharge can take place either alone under the pressure of the supplied blow air or even with the help of an additional suction device. By this rapid discharge of the water vapor an attempt is made to accelerate the drying of the paper web. The paper web will evaporate more intensively than hitherto at the web stabilizers according to the invention and thus also cool down to a greater extent, so that it can absorb more thermal energy at the succeeding drying cylinder than hitherto.

Similar to the subject matter of said reference No. 36 30 571, with the subject matter of this application it is desired that the web stabilizer should as far as possible extend over the entire length of the open draw of the fibrous web. At the same time, however, it is desired to manage with as low a number of nozzle elements as possible in each web stabilizer in order to keep the consumption of blow air within reasonable limits. Preferably, for example, provision is therefore made for only two or three nozzle elements in a web stabilizer. This at the same time has the advantage that the exhaust-air spaces at the discharge side of the nozzle elements (and thus also between each two nozzle elements) are relatively large, so that the discharge of the exhaust air is facilitated. In order now to avoid the fibrous web between two nozzle elements from being drawn unnecessarily far into the exhaust-air space due to the vacuum created between the elements, according to a further aspect of the invention the difference between the pressure of the supplied blow air and the pressure of the exhaust air is made adjustable. For this purpose a control valve is provided either in the supply-air or in the exhaust-air pipe. The arrangement of this control valve in the exhaust-air pipe is in general the more favorable alternative.

In a preferred embodiment of the invention the aforementioned difference between the pressure of the supplied blow air and the pressure of the exhaust air can be regulated to a constant value by means of a regulating unit which actuates the said control valve. According to one embodiment of the invention, a control system can be provided in which:

(a) in the web stabilizer is provided a feeler gauge for the continuous measurement of the distance of the fibrous web from a plane which is determined by the web guiding surfaces;

(b) a regulating unit compares the measured value determined by the feeler gauge with an adjustable set point and adjusts—in the event of a variance of the measured value from the setpoint—the said control valve such that the measured value approaches the setpoint.

According to an important further aspect of the invention, the web stabilizers are arranged at that side of the open paper draws which has contacted the preceding drying cylinder in each case. This means, in other words: the web stabilizer arranged in a certain pocket is—at variance with the subject of German Pat. Document No. 36 30 571 —not arranged at the paper draw running towards the respective cylinder, but at the paper draw running off the drying cylinder (In this connection is means that drying cylinder whose free shell area bounds the pocket concerned). An advantage of this arrangement according to the invention consists in that at the web stabilizers the blow air is now supplied to that side of the paper which previously had absorbed heat directly from the drying cylinder. By this means the above-described acceleration of the drying process is advanced still further.

At the same time the carrier rolls can be arranged so that they are, at a certain distance from the exiting side of the paper web from the drying cylinder, tangent to the paper web, so that the paper web is guided part of the way by the dryer fabric. In this case it is particularly expedient to design the web stabilizer in the direction of web travel to be so long that it extends from the area where the paper web runs off the carrier roll up to the area where the paper web runs onto the succeeding drying cylinder. It is possible to lead the paper web for a short distance on both sides, i.e. on one side by the web stabilizer and on the other side by the carrier roll with the dryer fabric or by the drying cylinder.

BRIEF DESCRIPTION OF THE DRAWINGS

Embodiments of the invention are described in the following sections with reference to the drawings.

DETAILED DESCRIPTION OF THE PREFERRED EMBODIMENTS

Figure 1:
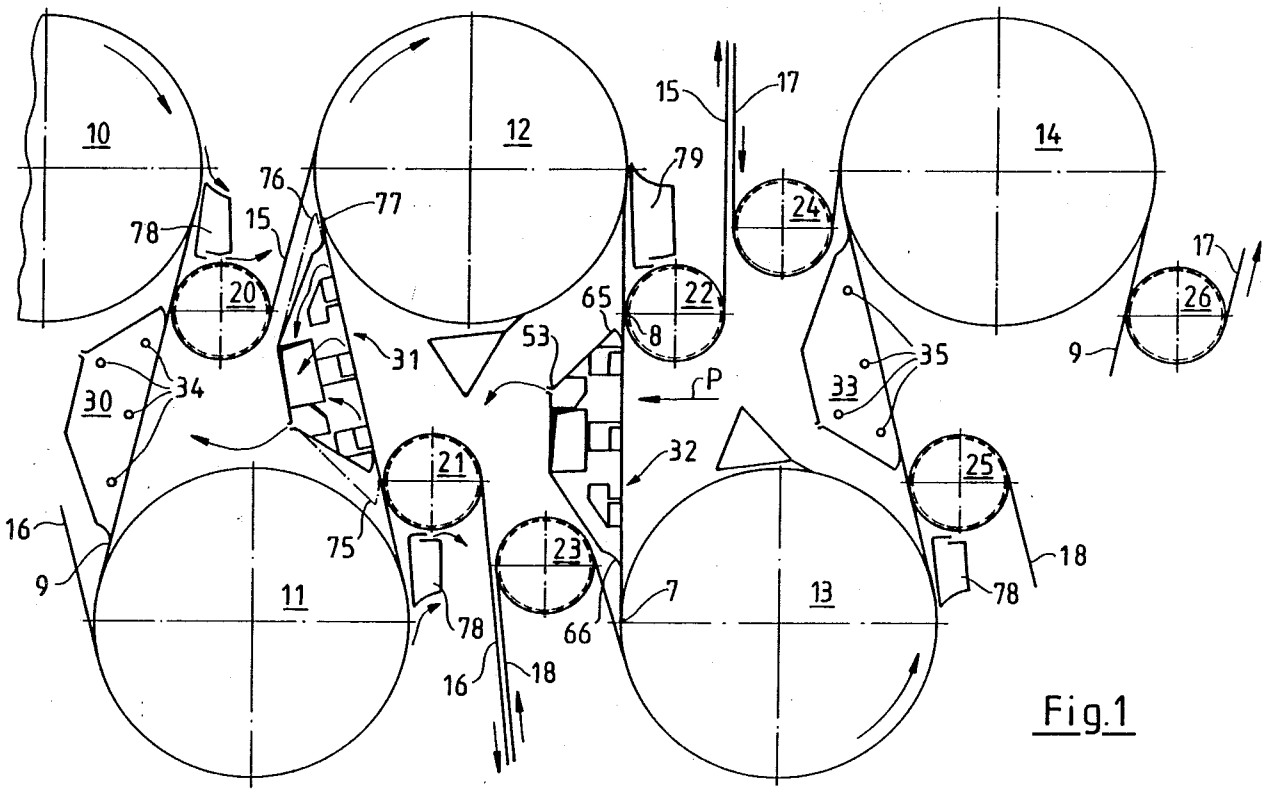
FIG. 1 shows schematically a part of a dryer section in side view.

In FIG. 1 five drying cylinders 10 to 14 of a dryer section are shown. The first three cylinders 10, 11 and 12 belong to a front dryer group with a top supporting belt or dryer fabric 15, which runs over the top cylinders 10 and 12 as well as over carrier rolls 20 and 22. The front dryer group has, moreover, a bottom dryer fabric 16, which runs over the bottom drying cylinders and over bottom carrier rolls, of these, only one drying cylinder 11 and one carrier roll 21 are visible. Of the rear dryer group only one bottom drying cylinder 13 with dryer fabric 18 and carrier rolls 23, 25 is visible, in addition one top drying cylinder 14 with dryer fabric 17 and carrier rolls 24, 26. It is understood that both dryer groups exhibit in known way a much larger number of drying cylinders, for example, ten each. In addition, as likewise known, the front dryer group 10, 11, 12 can at least be preceded by one additional dryer group, in which only one single supporting belt is provided, which runs together with the paper web from cylinder to cylinder In FIG. 1 the paper web 9 is first pressed by the top dryer fabric 15 onto the drying cylinder 10 and then runs together with the dryer fabric up to carrier roll 20. At this point the paper web 9 separates from the dryer fabric 15 and runs as an open paper draw to the next drying cylinder 11. Arranged along this open draw is a web stabilizer 30 designed according to the invention, said web stabilizer being described below in detail. Onto the bottom cylinder 11 the paper web 9 is pressed by the bottom dryer fabric 16, after which both again run up to the next carrier roll 21. From here the paper web runs in the open paper draw to the next cylinder 12 and in the same way runs meandering over the other drying cylinders 13 and 14.

The four supporting belts or dryer fabrics 15, 16, 17 and 18 visible in FIG. 1 are in the known way endless belts. The bottom dryer fabric 16 runs from the carrier roll 21 downwards and over non-shown further carrier rolls back to the beginning of the front dryer group. In the same manner the top dryer fabric 15 runs in the top area of the dryer section back to the beginning of the front dryer group. Designed in the same way are the circulating paths of the two dryer fabrics 17 and 18 of the rear dryer group. The carrier rolls 20–26 may exhibit peripheral grooves, so that less air is transported through the dryer fabrics 15–18 into the pockets.

Just as a web stabilizer 30 is arranged at the open paper draw between cylinders 10 and 11, web stabilizers 31, 32 and 33 are also located at the following open paper draws. The two web stabilizers 30 an 33 are shown simplified in side elevation; here four blow-air connections 34 or 35 each can be seen. The other web stabilizers 31 and 32 are shown in the cross-section; see also the enlarged cross-section of the web stabilizer 32 in FIG. 2. Each of these web stabilizers, e.g. 30, is arranged on that side of the paper web 9 which previously had been in direct contact with one of the drying cylinders, e.g. 10.

Figure 2:
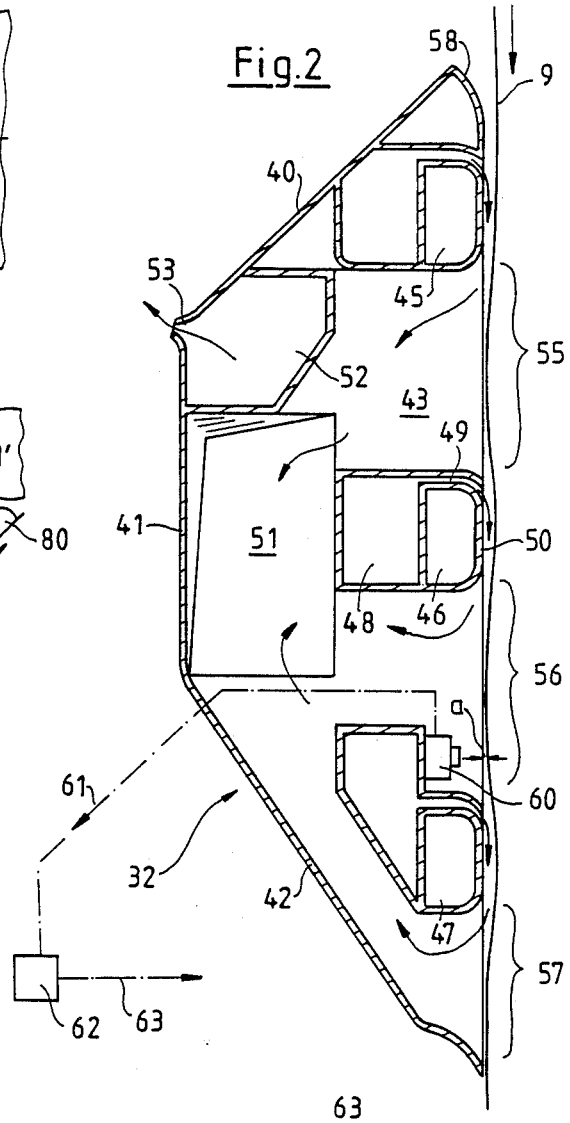
FIG. 2 shows one of the web stabilizers of FIG. 1 in a cross-section enlarged with respect to FIG. 1.
Figure 3:
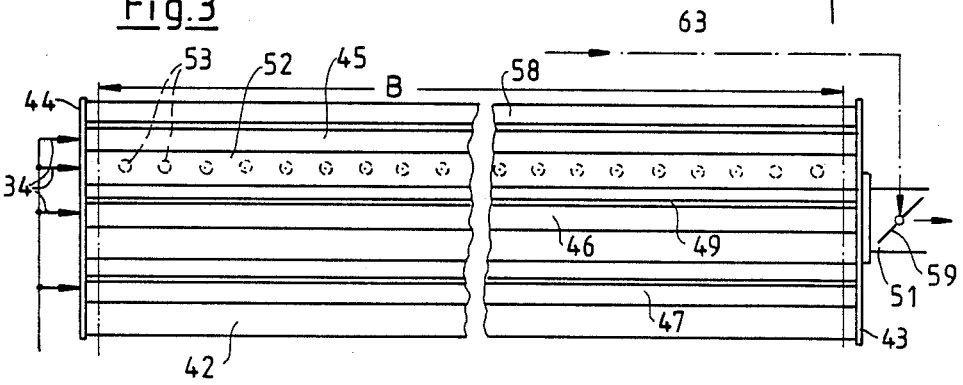
FIG. 3 shows an elevation in the direction of arrow P of FIG. 1 on one of the web stabilizers.

According to FIGS. 2 and 3 the single web stabilizer 32 is essentially a box which is open towards the paper web 9, with longitudinal walls 40, 41 and 42, which extend transversely (from the tending to the drive side)

through the entire dryer section, as well as with two face-end side walls 43 and 44. The total length of the box is somewhat greater than the width B of the paper web 9. Along the open side of this box, i.e. along the running path of the paper web 9 are arranged three nozzle elements 45, 46 and 47, which extend over the entire box length. These nozzle elements are designed according to the type of the well-known Airfoil (e.g. U.S. Pat. No. 3,587,177); i.e. each one has a supply-air duct 48 and an air blow slot 49 opening towards the paper web as well as a rounded-off web-guiding surface 50. The air exiting from the air blow slot 49 is conducted over the web-guiding surface utilizing the well-known Coanda affect. The important thing is that this should take place at all nozzle elements 45, 46 and 47 in the same direction as the paper web 9 runs. The paper web 9 is hereby guided safely along the open side of the web stabilizer 32. At the same time the blow air removes water vapor from the paper web previously heated on a drying cylinder. When the blow air leaves the web-guiding surface 50, it is caught in the interior of the box and discharged through a lateral exhaust-air duct 51. To facilitate this, large distances are provided between the nozzle elements 45, 46 and 47. A relatively large distance is also provided between the last nozzle element 47 in running direction and the adjacent longitudinal wall 42. Due to this there is a relatively large. exhaust-air space 55, 56, 57 available on the discharge side of each nozzle element. All these exhaust-air spaces communicate with the exhaust-air duct 51.

In the area of the web stabilizer 32 facing away from the paper web 9 is arranged an additional supply-air duct 52 which also extends over the entire length of the box and on which are provided a number of additional blow openings 53, e.g. at the boundary between the longitudinal walls 40 and 41. Slots can also be provided instead of the round blow openings shown. Due to the blow air exiting here, an adjustable but relatively low overpressure can be maintained in the pocket concerned. This may be necessary if, due to the transport effect of the (pocket-limiting) dryer fabric, too much air is pumped outwards.

If vacuum were created in the pocket because of this, air would penetrate from the sides into the interior of the pocket; this would cause an over-drying of the paper web edges.

FIG. 3 shows schematically also the supply-air pipes 34 entering the web stabilizer 32. Each supply-air duct 48 of the three nozzle elements has its own supply-air connection. The same applies to the additional supply-air duct 53. In addition, the exhaust-air duct 51 can be seen, and a throttle flap 59 is arranged therein. This is used for the adjustment of the desired difference between the pressure of the supplied blow air and the pressure of the exhaust air. This adjustability must be provided in particular when a (non-shown) suction device is provided for discharge of the exhaust air. The difference between the said pressures is adjusted in such a way that the paper web 9 in the area of the exhaust-air spaces 55, 56 and 57 is not deflected or deflected only minimally, as shown in FIG. 2, towards the web stabilizer 32. At the same time it can be ensured that the same ratio between the quantity of supply air and exhaust air assumes a desired value in each web stabilizer, e.g. the value 1:1. This measure may contribute to having a precisely adjustable and relatively low overpressure prevailing in the pocket concerned—as already mentioned above. A further measure to attain this objective may consist in making the volume of the pockets relatively large (by enlargement of the cylinder diameter to, e.g. 2.0 to 2.5 m) so that the velocity of the air currents in the pockets is kept low.

If required, the following can be provided with the aid of a feeler gauge 60 the distance a of the paper web 9 can be measured, for example, from a plane which is determined by the web-guiding surface 50. The measured value determined is fed via a gauge line 61 to a control unit 62. This compares the measured value with an adjustable setpoint and influences via a control line 63 a non-shown actuating unit for the throttle flap 59 in the sense that the distance "a" is controlled to a desired value.

In the following, reference is again made to FIG. 1. This shows, taking the web stabilizer 32 as an example, that its supply-side end 65 in the direction of web travel is arranged shortly after the point 8 where the paper web 9 leaves the carrier roll 22 and the dryer fabric 15. In addition, it can be seen that the discharge end 66 of the web stabilizer 32 in the direction of travel is arranged shortly ahead of the point 7 where the paper web 9 runs onto the subsequent drying cylinder 13.

Figure 4:
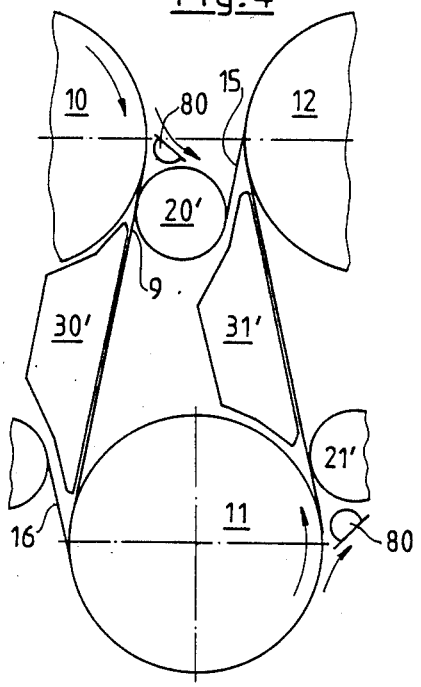
FIG. 4 shows schematically an alternative to FIG. 1.

In this respect one can, however, go yet one step further, as is shown by way of example of the web stabilizer 31. This can, at variance with the embodiment shown in solid lines, be extended as shown by the chain lines. It can be achieved, for example, in this way that the discharge end 76 is arranged at or shortly after the point 77 where the paper web 9 runs onto the succeeding drying cylinder 12. In a similar way the supply-side end 75 of the web stabilizer 31 can be shifted closer to the carrier roll 21. The supply-side end of the web stabilizers (e.g. 32, FIG. 2) is provided with a rounding 58 towards the paper web 9. This measure will contribute to making it possible for the transfer tail to be led through the dryer section without a rope carrier system. At the points where the paper web 9 runs off together with the respective dryer fabric (e.g. 15) from one of the drying cylinders (e.g. 10, 12), a (e.g. from U.S. Pat. No. 4,502,231) known additional web stabilizer 78 or 79 can be provided By means of a blow-air jet this causes the air to be drawn out of the nip between dryer fabric (e.g. 15) and carrier roll (e.g. 20) so that the paper web 9 adheres at the run-off point of the cylinder (e.g. 10) securely to the dryer fabric As per FIG. 4—at variance with FIG. 1—the following can be provided: the carrier rolls 20' and 21' are arranged at a shortened distance from the respective preceding drying cylinder 10, 11.

Thus, the additional web stabilizers 78 and 79 required in FIG. 1, which consume blow-air, are omitted In their place simple strips 80 are sufficient at these points for reversing of the boundary layer. For reliable guiding of the now lengthened open paper draws the web stabilizers 30' and 31' designed according to the invention are likewise lengthened as compared with FIG. 1. If necessary, four or five instead of only three nozzle elements are provided in each web stabilizer 30', 31'.

What is claimed is:

1. A dryer section for a machine for the processing of fibrous webs, in particular paper webs, comprising:

several heatable drying cylinders arranged in a top row and a bottom row one above the other so that the fibrous web can meander over each drying cylinder successively while traveling in a running direction through the dryer section;

several carrier rolls associated with said several heatable drying cylinders, with at least one carrier roll disposed in one of said rows and located opposite a drying cylinder of the other row;

at least one top supporting belt allotted to the top row of cylinders and at least one bottom supporting belt allotted to the bottom row of cylinders, with each supporting belt running in the direction of web travel on a drying cylinder and over a carrier roll;

several air pockets associated with said heatable drying cylinders, each air pocket being delimited by a free peripheral part of a drying cylinder, by the opposite carrier roll and by the fibrous web; and several web stabilizers, each disposed in one of the air pockets, for contactless stabilization of the run of the fibrous web, each of said web stabilizers including at least one nozzle element extending transversely across the width of the fibrous web and connected to a supply-air pipe, the nozzle element having an air blow slot open towards the fibrous web and a web-guiding surface interacting therewith;

said nozzle element being arranged in such a way that the direction of flow of the blow air over the web-guiding surface is the same as the running direction of the fibrous web, and said nozzle element having an exhaust side;

said nozzle element being arranged inside an exhaust air box having an exhaust air space on the exhaust side of each nozzle element, to which exhaust space is connected a pipe for the re-exhaust of the supplied blow air.

2. The dryer section according to claim 1, in which a throttle valve is provided for setting a selectable difference between the pressure of the supplied blow air and the pressure of the exhaust air.

3. The dryer section according to claim 1, in which each web stabilizer is arranged on that side of the fibrous web which has contacted the preceding drying cylinder.

4. The dryer section according to claim 3, in which a carrier roll is arranged with respect to at least one of the drying cylinders such that the carrier roll's periphery is tangent to the running path of the fibrous web at a distance from the exit point of the fibrous web from the drying cylinder, wherein the web stabilizer, viewed from the side, extends from the area where the fibrous web runs off the carrier roll to the area where the fibrous web runs onto the succeeding drying cylinder.

5. The dryer section according to claim 4, in which the inlet side of the web stabilizer is arranged in the direction of web travel shortly after the point where the fibrous web runs off the carrier roll.

6. The dryer section according to claim 4, in which the inlet side of the web stabilizer is arranged at or shortly ahead of the point where the fibrous web runs off the carrier roll.

7. The dryer section according to claim 4, in which the discharge end of the web stabilizer is arranged in the direction of web travel shortly ahead of the point where the fibrous web runs onto the succeeding cylinder

8. The dryer section according to claim 4, in which the discharge end of the web stabilizer is arranged at or shortly after the point where the fibrous web runs onto the succeeding drying cylinder.

9. The dryer section according to claim 1, in which a feeler gauge is provided in the web stabilizer for the continuous measurement of the distance of the fibrous web from the web guiding surface, and a regulating unit is provided for comparing the measured value determined by the feeler gauge with an adjustable setpoint and adjusting, in the vent of a variance of the measured value from the setpoint, the said control valve such that the measured value approaches the setpoint.

10. The dryer section according to claim 9, in which the feeler gauge is arranged beside the nozzle element.

11. The dryer section according to claim 1, in which in the web stabilizer is arranged an additional supply-air duct which is connected to the air pocket by means of additional blow openings.

12. The dryer section according to claim 4, in which the fibrous web and the supporting belt have a common running path from a drying cylinder to the said carrier roll, and at said common running path is arranged an additional web stabilizer which draws the fibrous web to the supporting belt by suction.

13. The dryer section according to claim 1, in which the drying cylinders have an outside diameter of approximately between 2.0 and 2.5 m.

14. The dryer section according to claim 4, in which the carrier roll is arranged at an only very short distance from the exiting point of the fibrous web from the drying cylinder and the web stabilizer is correspondingly lengthened.

15. The dryer section according to claim 14, in which a purely mechanically acting strip is provided in the area of the exiting point of the fibrous web from the drying cylinder for air boundary layer reversal.

* * * * *